United States Patent [19]

Myzenkov et al.

[11] 4,174,372

[45] Nov. 13, 1979

[54] PROCESS FOR TREATMENT OF ANTIMONY-CONTAINING MATERIALS

[76] Inventors: Felix A. Myzenkov, ulitsa Vavilova, 93, kv. 9; Dmitry N. Klushin, Bolshoi Matrossky pereulok, 1, kv. 64; Viktor A. Shupikov, ulitsa Nagornaya, 15, korpus 11a, kv. 118, all of Moscow; Alexandr A. Kaizer, ulitsa Klubnaya, 3, kv. 1; Anatoly M. Shuklin, ulitsa Klubnaya, 3, kv. 2, both of Kirgizskaya SSR, Oshskaya oblast, Frunzensky raion, poselok Frunze; Mikhail D. Deresh, ulitsa Junykh Lenintsev, 89, korpus 2, kv. 52, Moscow; Nikolai A. Kolbin, Tashavtomash, 31, kv. 47, Tashkent; Alla P. Tolmacheva, ulitsa Vavilova, 93, kv. 9; Galina V. Zyryanova, ulitsa Petrozavodskaya, 15, korpus 2, kv. 144, both of Moscow; Vitaly M. Uzlov, ulitsa Kirova, 10, kv. 5, Kirgizskaya SSR, Oshskaya oblast, Frunzensky raion, poselok Frunze; Elka I. Shmuelzon, ulitsa Metrostroevskaya, 35, kv. 38, Moscow, all of U.S.S.R.

[21] Appl. No.: 819,001

[22] Filed: Jul. 26, 1977

[51] Int. Cl.[2] ..... C01B 29/00

[52] U.S. Cl. ..... 423/88; 423/DIG. 16; 431/7; 431/170; 431/351

[58] Field of Search ..... 423/88, DIG. 16; 432/15, 58; 431/7, 170, 351

[56] References Cited

U.S. PATENT DOCUMENTS

| | | | |
|---|---|---|---|
| 2,095,065 | 10/1937 | Hays | 431/7 |
| 3,370,938 | 2/1968 | Newman et al. | 423/542 |
| 3,511,487 | 5/1970 | Desty | 432/15 |

*Primary Examiner*—Delbert E. Gantz
*Assistant Examiner*—Wayne A. Langel
*Attorney, Agent, or Firm*—J. Harold Nissen

[57] ABSTRACT

A process for treatment of antimony-containing materials in a fluidized bed by way of calcination of the materials at a temperature within the range of from 800° to 1,100° C. obtained by combusting a mixture of a fuel gas and an oxygen-containing gas in said fluidized bed. Said mixture of the gases is formed directly in said fluidized bed by supplying, thereinto, the fuel gas and oxygen-containing gas in separated streams uniformly distributed over the bottom cross-section of said fluidized bed so that the fuel gas stream is surrounded over the entire perimeter by the oxygen-containing gas streams.

The process according to the present invention makes it possible to treat antimony-containing materials with a content of antimony ranging from 0.3 to 15% by weight and to obtain antimony-rich sublimates with a content of antimony as high as 40 to 75% by weight.

10 Claims, 1 Drawing Figure

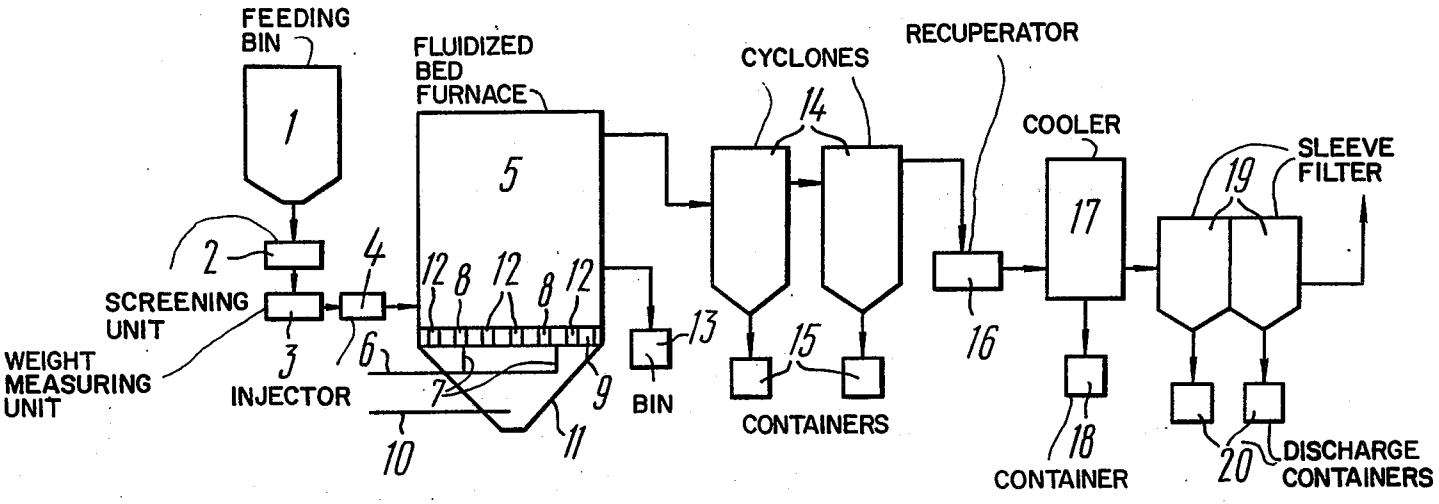
FEEDING BIN
1
2
SCREENING UNIT
WEIGHT MEASURING UNIT
3
4
INJECTOR
6
FLUIDIZED BED FURNACE
5
12
8
7
9
11
10
BIN
13
CYCLONES
14
CONTAINERS
15
RECUPERATOR
16
COOLER
17
CONTAINER
18
SLEEVE FILTER
19
DISCHARGE CONTAINERS
20

PROCESS FOR TREATMENT OF ANTIMONY-CONTAINING MATERIALS

The present invention relates to non-ferrous metallurgy and, more specifically, it relates to a process for treatment of materials containing metals and compounds thereof, more particularly, to a process for treatment of antimony-containing materials.

Such materials might be exemplified by sulphide-oxidized ores and concentrates, enrichment tailings, leaching cakes, waste and intermediate produces of metallurgic manufacture and other materials containing antimony in the form of oxides, sulphides or mixtures thereof.

Prior art processes for treatment of said materials are based on calcination of the starting stock in a fluidized bed in a weakly-reducing atmosphere.

In doing so, higher non-volatile oxides of antimony are reduced to a volatile antimonous oxide which is entrained with the gas stream into a dust-collecting system. Antimonous sulphide, if present, is entrained along with the gas stream without being subjected to any changes.

Volatile antimony compounds are concentrated within the system of fine-dust collection in the form of antimony-rich referred to as "sublimates" which are then delivered to a further processing to recover antimony.

The process of treating antimonous materials by way of sublimational calcination is endothermal wherefore heat supply is required to perform said process.

In a prior art process for treatment of an antimony-containing starting stock coal is used as a source of heat and as a reducing agent as well; the coal is charged into a fluidized-bed furnace along with the starting stock.

The process has certain disadvantages such as the necessity of preliminary treatment of the coal, a high consumption rate thereof, a high ash content causing sintering of the cinder at the furnace bottom thus affecting the fluidization process. For this reason, the range of processable stock could not involve the products containing low-melting compounds such as leaching cakes, cinders remaining after the removal of mercury from mercury-antimony stock and the like.

The sublimates produced in said prior art processes have an insufficient content of antimony, i.e. about 29–30%.

A step forward in the development of the sublimation process for recovering antimony from antimonial raw materials consisted in the shift to the use of a gaseous fuel.

Known in the art is a process for recovering antimony from antimony-lead-zinc ores.

The antimonous raw materials are subjected to calcination in a fluidized-bed furnace at a temperature within the range of from 900 to 1,000° C. which temperature is maintained by way of supplying hot flue gases into the fluidized bed. The sublimates obtained in this process contain 34% by weight of antimony, while the residual content of antimony in cinders is 0.39% by weight.

The above-described process does not make it possible to elevate the fluidized bed temperature above 1,000° C. which is necessary to ensure a good sublimation of antimony and to obtain antimony-lean cinders such as cinders containing 0.04% by weight of antimony.

This is attributed to the fact that to maintian the fluidized bed temperature above 1,000° C., for example at 1,050 to 1,100° C. it is necessary that the supplied hot flue gases be heated to a temperature of at least 1,250–1,300° C. However, the supply of flue gases having such a high temperature is rather difficult technically and results in a rapid breakdown of metallic structure of the furnace bottom. Another disadvantage of the above-described process of treating antimony-containing materials in a fluidized bed resides in the necessity of provisions of an additional unit for combustion of the gas and transportation of the gas combustion products, i.e. flue gases, to the bottom of the fluidizedbed furnace. Moreover, the process does not enable the formation of a uniform gaseous atmosphere over the entire volume of the fluidized bed which also is a reason of an unsatisfactory sublimation of antimony.

Also known in the art is a process for recovering antimony from rich sulphide materials containing 13 to 28% of antimony and 23–24% of sulphur in a fluidized bed.

Air heated to a temperature within the range of from 300 to 400° C. and containing 5 to 10% by volume of oxygen is supplied through the furnace bottom. The fluidized bed temperature is maintained at 650–750° C. which is ensured due to burning of the starting stock sulphur. The degree of antimony recovery is about 90% and over.

The residual content of antimony in the cinders is 1.8 to 2.0% and in dusts it is 8.57 to 13.8% upon the degree of recovery of 90.5%.

This prior art process has the following disadvantages:

1. It does not enable the creation of a reducing atmosphere which makes it unsuitable for the treatment of oxidized and sulphide-oxidized raw materials.

2. It features a low recovery degree, i.e. 90.5% with the residual content of antimony in cinders of 1.8 to 2.0% and for this reason can be utilized only for processing of sulphide raw materials with the content of antimony of 13.5% and over.

3. It requires an additional unit for preparation of an air mixture (apparently during combustion of the fuel) with a content of oxygen of from 5 to 10% by volume.

It is an object of the present invention to provide a process for treatment of antimony-containing materials which would make it possible to increase the degree of recovery of antimony into sublimates, to intensify the process and lower the production costs.

The herein-proposed process for the treatment of antimonycontaining materials involves calcination of said materials in a fluidized bed formed by said material, a fuel gas and an oxygen-containing gas at a temperature within the range of from 800 to 1,000° C. produced from combustion of a mixture of said fuel gas and said oxygen-containing gas; therewith, said gas mixture is formed directly in the fluidized bed by supplying into said fluidized bed said fuel gas and oxygencontaining gas as separate streams uniformly distributed over the fluidized bed bottom so that the fuel gas stream is surrounded over its entire perimeter by the oxygencontaining gas streams.

In accordance with the present invention the fuel gas is fed into the fluidized bed under a pressure of from 0.03 to 3.0 atm.g. and the oxygen-containing gas - under the pressure of from 0.02 to 1.5 atm.g. Said pressure limits are selected with the amount of the fluidized bed height variation being within the range of from 1.0 to 2.1 m.

In accordance with the present invention for the oxygen containing gas use is made of air or oxygen-enriched air; and, for the fuel gas use is made of natural gas, blast-furnace gas or other fuel gases.

The fuel gas and the oxygen-containing gas can be fed into the fluidized bed while being pre-heated to the temperature of 700° C. which makes it possible to reduce the consumption rate of natural gas.

The process is conducted, as it has been mentioned hereinbefore, at the fluidized bed temperature within the range of from 800 to 1,100° C. The use of process temperatures below 800° C. results in a lowered degree of antimony recovery, while temperatures above 1,100° C. cause sintering of the antimony-containing material and deteriorated conditions of the fluidization.

The present invention makes it possible:

1. To process previously non-utilizable oxidized and sulphide-oxidized ores, waste raw materials, intermediate products from antimony production and other products such as leaching cakes, slags, mattes and miscellaneous antimony containing wastes containing 0.3 to 15% by weight of antimony 2. To reduce a content of antimony in cinders down to 0.04% by weight.

3. To increase the content of antimony in sublimates up to 40–75% by weight and to achieve a degree of recovery of antimony into sublimates of up to 83–96%.

4. To lower production costs of the final antimony.

5. To create a uniform and controlled gaseous atmosphere within the entire volume of the fluidized bed and to obtain temperature therein of 800° C. and above.

6. To provide a complete safety (non-hazardous character) of the process.

According to the present invention there is no need in preliminary intermixing of the fuel mixture components, i.e. air and fuel gas, whereby the process technology becomes substantially simplified.

These and other advantages of the present invention will now become more fully apparent from the following detailed description of the process, the reference being given to the accompanying drawing showing a general diagram of the process for treating antimony-containing raw materials.

The antimony-containing starting stock from a supply bin 1 is delivered into a screening unit 2, weight-measuring unit 3 and then is delivered, by means of an injection-charging means 4, into a fluidized-bed furnace 5.

A fuel gas from a manifold 6 is fed via lines 7 and openings 8 provided in a bottom plate 9 into the fluidized-bed furnace 5.

The openings 8 in the bottom plate 9 are disposed uniformly over the entire area of the bottom plate 9.

An oxygen-containing gas is fed via a line 10 into an air box 11, wherefrom it is further delivered, via openings 12 provided in said bottom plate 9, into the fluidized-bed furnace 5. The openings 12 in the bottom plate 9 are disposed in such a manner that they encircle the gas openings 8.

Therefore, steams of the fuel gas from gas openings 8 are surrounded by streams of the oxygen-containing gas supplied from the openings 12.

The fuel gas is admitted into the fluidized bed under a pressure within the range of from 0.03 to 3.0 atm.g., while the oxygen-containing gas—under a pressure of from 0.02 to 1.5 atm.g.

This technique of the supply and distribution of streams of the fuel gas and oxygen-containing gas ensures a good intermixing of the fuel mixture components and provides for a uniform gaseous atmosphere and a uniform and high temperature within the range of from 800° to 1,100° C. within the entire volume of the fluidized bed.

Under said conditions there are provided an intensive reduction of higher antimony oxides and sublimation of antimonous oxide and other volatile compounds thereof such as antimonous sulphide.

The cinder from the fluidized-bed furnace 5 is delivered into a bin 13, wherefrom it is discharged as a refuse product.

The gases leaving the fluidized-bed furnace 5 are passed into cyclones 14, wherein they are cleaned to remove mechanical dust therefrom. THe dust collected in said cyclones 14 is discharged into containers 15 and then discarded as a refuse product, whereas the dust-cleaned gases are fed into a recuperator 16 and cooler 17 for cooling. Upon cooling, a portion of sublimates is settled in the cooler 17, wherefrom it is discharged into a container 18. From the cooler 17 the gas is fed into sleeve-filters 19, wherein the sublimates of antimony are completely settled. From the sleeve-filters 19 the antimony sublimates are discharged into containers 20 and further delivered, along with the sublimates in containers 18 to subsequent treatment for recovery of matallic antimony.

From the sleeve filters 19 the gases exempted from the sublimates are delivered to the atmosphere.

In accordance with the present invention, the fuel gas and the oxygen-containing gas can be fed into the fluidized bed while being pre-heated to the temperature of 700° C.

For a better understanding of the present invention, some specific Examples are given hereinbelow with reference to the accompanying drawings.

EXAMPLE 1

An antimony-containing stock is delivered to the treatment which comprises a mixture of enrichment tailings with refuse products of metallurgical production having the following chemical composition, percent by weight: Sb, 0.5 to 1.5; As, 0.008; S, 0.2–2.25; $SiO_2$, 85–92; $Na_2O$, 0.1–0.5; humidity, 5.

| Sieve fractions: | | | | | | |
|---|---|---|---|---|---|---|
| Sieve hole dimensions, mm | 1.25 | 0.4 | 0.14 | 0.1 | below | 0.1 |
| Fraction yield, wt. % | 4.8 | 26.2 | 52.5 | 9.7 | | 6.8 |
| Average grain diameter, mm | | | 0.39. | | | |

From the feeding bin 1 the antimony-containing material of the above-mentioned composition is passed through the screening unit 2, weight-measuring unit 3 and is fed, by means of an injector means 4, into a preheated fluidizedbed furnace 5 with the diameter of 4.1 m and height of 10.8 m.

Natural gas and air are fed into the fluidized-bed furnace 5 through the openings 8 and 12 of the bottom plate 9 as separate streams shown in the diagram.

Charging of the starting stock is effected continuously at the rate of 9–10 ton/hr. Air supply rate is within the range of from 7,000 to 9,000 $Nm^3$/hr; supply rate of natural gas is 700 to 900 $Nm^3$/hr. Therewith, the coefficient of air excess ($\alpha$) is varied from 0.75 to 0.98. Pressure of natural gas is 0.10 to 0.3 atm.g. and air pressure is 0.09 to 0.18 atm.g. The fluidized bed temperature is maintained within the range of from 950° to 1,050° C. and adjusted by changing the supply rate of the starting stock being charged into the system.

In the fluidized bed with the height of 1.5 m, over its entire area and at the height of 200 mm above the bottom plate there are positioned gas-intake pipes (not shown) for sampling of the gas and determination of the content of CO, $H_2$ and $O_2$ in the samples.

The gas samples are taken simultaneously from different points of the fluidized bed. Analysis of these gas samples generally show an identic composition of the gaseous phase in various points of the fluidized bed, namely: 0.5–5.0% by volume of CO, 0.5–6.0% by volume of hydrogen; no oxygen is detected.

These analyses prove that a good intermixing of natural gas and air is achieved in the fluidized bed, wherefore a required weakly-reducing atmosphere is created owing to the employed, in the present invention, technique of supplying the fuel gas and oxygen-containing gas in separate streams.

The treatment of antimony-containing materials in a fluidized bed with separately supplied fuel gas and oxygen-containing gas and combustion of a mixture thereof directly in the fluidized bed ensures a high and uniform temperature within the fluidized bed, a uniform gaseous atmosphere over the entire fluidized bed volume, thus resulting in the production of sublimates containing 40 to 50% by weight of antimony and a cinder with a residual antimony content of from 0.04 to 0.06% by weight. The degree of antimony recovery in this Example is within the range of from 83 to 88% .

EXAMPLE 2

Delivered to the treatment is a mixture of enrichment tailings and an intermediate product resulting from removal of mercury from a mercury-antimony raw material having the following chemical compositions, percent by weight: Sb, 1.5 to 5; S, 5 to 12; Fe, 1.5 to 2.0; $SiO_2$, 70 to 85; $CaF_2$, 1.5; CaO, 0.2; average grain diameter is 0.33 mm.

The process is conducted under the conditions of the foregoing Example 1, except that air is fed into the fluidizedbed furnace in a pre-heated state, i.e. heated to a temperature within the range of from 300° to 400° C. Coefficient of air excess ($\alpha$) is varied within the range of from 0.9 to 1.2 depending on the content of sulphur in the starting stock.

As a result of treatment of this raw material sublimates are obtained with the content of antimony of from 60 to 65% by weight, a cinder with a residual antimony content of from 0.06 to 0.2% by weight. The degree of antimony recovery into the sublimates is 94%.

EXAMPLE 3

Subjected to the treatment is a low-melting, antimony-rich intermediate product obtained after removal of mercury from a mercury-antimony raw material having the following chemical composition, percent by weight: Sb, 5 to 10; S, 6.0 to 15.0; Fe, 1.7 to 2.8; $SiO_2$, 70 to 82; $A1_2O_3$, o.5 to 1.5; $CaF_2$, 1.5 to 3.0; average grain diameter of the material is 0.25 mm.

Calcination is conducted at a temperature within the range of from 850° to 870° C. at the value of air excess coefficient of from 0.95 to 1.25, height of the fluidized bed of 2.0 m. Natural gas pressure is 0.15 to 0.55 atm.g. Air lpressure is 0.12 to 0.22 atm.g.

In this Example sublimates are obtained with the content of antimony 75% by weight.

The degree of antimony recovery is 90 to 96% .

What is claimed is:

1. A process for treatment in a fluidized bed of antimony-containing materials involving combustion of the materials in the fluidized bed formed by the material, a fuel gas and an oxygen-containing gas at a temperature within the range of from 800° to 1,100° C. obtained by combusting a mixture of said fuel gas and oxygen-containing gas, supplying said fuel gas and said oxygen-containing gas through separated openings to the fluidized bed, and forming said gas mixture directly in the fluidized bed after supplying thereinto said fuel gas and oxygen-containing gas as separate streams through said separate openings and uniformly distributed over the bottom of the fluidized bed so that the fuel gas stream is surrounded in the fluidized bed over its entire perimeter by the oxygen-containing gas streams.

2. A process as claimed in claim 1,wherein the fuel gas is a natural gas which is fed at a rate of from 700 to 900 $Nm^3$/hr. under a pressure of from 0.10 to 0.3 atm.g., and the oxygen-containing gas is air which is fed at a rate of from 7,000 9,000 $Nm^3$/hr. under a pressure of 0.09 to 0.18 atm. g., and the temperature of the fluidized bed is maintained within the range of from 950° to 1,050° C.

3. A process as claimed in claim 2, wherein the air fed into the fluidized bed is preheated to a temperature within the range of 300° to 400° C.

4. A process as claimed in claim 1, wherein the fuel gas is fed into the fluized bed under a pressure of from 0.03 to 3.0 atm.g. and the oxygen-containing gas is fed under a pressure of from 0.02 to 1.5 atm.g.

5. A process as claimed in claim 1, wherein said fuel gas and said oxygen-containing gas are fed into the fluidized bed while being pre-heated to the temperature of 700° C.

6. A process as claimed in claim 1, wherein as the fuel gas use is made of natural gas.

7. A process as claimed in claim 1, wherein as the oxygen-containing gas use is made of air.

8. A process as clailmed in claim 1, wherein the oxygen containing gas is preheated air which is fed into the fluidized bed at a temperature between 300° to 400° C.

9. A process as claimed in claim 1, wherein the fuel gas is natural gas fed into the fluidized bed under a pressure between 0.15 and 0.55 atm.g. and the oxygen-containing gas is air which is fed under a pressure between 0.12 and 0.22 atm.g., and calcination is conducted at a temperature within the range of from 850° to 870° C.

10. A process as claimed in claim 1, wherein said fuel gas and said oxygen containing gas are isolated from each other and separately fed to said fluidized bed through openings therein, and the openings in the fluidized bed for the oxygen-containing gas streams encircles the openings for the fuel gas streams.

* * * * *

UNITED STATES PATENT AND TRADEMARK OFFICE

CERTIFICATE OF CORRECTION

PATENT NO. : 4,174,372

DATED : November 13, 1979

INVENTOR(S) : Felix A. Myzenkov et al

It is certified that error appears in the above-identified patent and that said Letters Patent are hereby corrected as shown below:

Column 1, Line 57 "fluidized-bed" should be --fluidized bed--

Column 2, Line 11 "provisions" should be --provision--

Line 52 "antimonycontaining" should be --antimony-containing--

Lines 59 and 60 "oxygencontaining" should be --oxygen-containing--

Column 3, Line 23 "antimony containing" should be --antimony-containing--

Line 24 there should be a period after "antimony"

Column 4, Line 17 "THe" should be --The--

Line 28 "matallic" should be --metallic--

Column 5, Line 44 "fluidizedbed" should be --fluidized bed--

Line 61 "o.5" should be --0.5--

Column 6, Line 2 "lpressure" should be --pressure--

Line 4 insert after "antimony" --of--

Line 15 "separated" should be --separate--

UNITED STATES PATENT AND TRADEMARK OFFICE

CERTIFICATE OF CORRECTION

PATENT NO. : 4,174,372

DATED : November 13, 1979

INVENTOR(S) : Felix A. Myzenkov et al

It is certified that error appears in the above-identified patent and that said Letters Patent are hereby corrected as shown below:

Column 6, Line 25 there should be a space after "claim 1,"

Line 29 "7,000 9,000" should be --7,000 to 9,000--

Line 48 "clailmed" should be --claimed--

Signed and Sealed this

*Eighth* Day of *July 1980*

[SEAL]

*Attest:*

SIDNEY A. DIAMOND

*Attesting Officer*

*Commissioner of Patents and Trademarks*